US009471004B1

(12) United States Patent
Li et al.

(10) Patent No.: US 9,471,004 B1
(45) Date of Patent: Oct. 18, 2016

(54) TONER SUPPLY CONTAINER AND APPLICATIONS OF SAME

(71) Applicant: GENERAL PLASTIC INDUSTRIAL CO., LTD., Taichung County (TW)

(72) Inventors: Kuan-Tung Li, Taichung County (TW); Yueh-Chun Lee, Taichung County (TW)

(73) Assignee: GENERAL PLASTIC INDUSTRIAL CO., LTD., Taichung County (TW)

( * ) Notice: Subject to any disclaimer, the term of this patent is extended or adjusted under 35 U.S.C. 154(b) by 0 days.

(21) Appl. No.: 14/877,625

(22) Filed: Oct. 7, 2015

(51) Int. Cl.
*G03G 15/08* (2006.01)

(52) U.S. Cl.
CPC ..... *G03G 15/0834* (2013.01); *G03G 15/0865* (2013.01); *G03G 15/0867* (2013.01); *G03G 2215/066* (2013.01)

(58) Field of Classification Search
CPC ..... G03G 15/0822; G03G 15/0834; G03G 15/0836; G03G 15/0837; G03G 15/0839; G03G 15/0867; G03G 15/0868; G03G 15/087; G03G 15/0872; G03G 15/0877; G03G 2215/066; G03G 2215/0663; G03G 2215/0665; G03G 2215/0668; G03G 2215/0678; G03G 2215/0685
See application file for complete search history.

(56) References Cited

U.S. PATENT DOCUMENTS

| | | | | |
|---|---|---|---|---|
| 4,660,871 | A * | 4/1987 | Arakawa | E05C 19/022 292/198 |
| 7,455,334 | B2 * | 11/2008 | Hisatomi | E05C 19/022 292/80 |
| 7,647,012 | B2 | 1/2010 | Yamada et al. | |
| 7,729,644 | B2 * | 6/2010 | Thornton | G03G 15/087 399/262 |
| 2011/0115146 | A1 * | 5/2011 | Shimomura | B65H 5/26 271/10.13 |

* cited by examiner

*Primary Examiner* — David Gray
*Assistant Examiner* — Carla Therrien
(74) *Attorney, Agent, or Firm* — Locke Lord LLP; Tim Tingkang Xia, Esq.

(57) ABSTRACT

A releasing mechanism usable for a toner supply container includes a groove fixable to the toner supply container, a releasing portion slidably fixable to the toner supply container, and a hook member. The releasing portion has an opening for releasing toner, and a fixing structure disposed over the groove. The hook member is disposed between the groove and the fixing structure, and has a first hook received in the groove, and a fixing portion fixable to the fixing structure. By operations of first and second forces pushing the releasing portion toward or away from the toner supply container, the first hook is slidable along the groove and is stoppable at first and second positions of the groove that are close to or away from the toner supply container, such that the releasing portion is movable relative to the toner supply container to provide or stop providing the toner.

20 Claims, 20 Drawing Sheets

TONER SUPPLY CONTAINER AND APPLICATIONS OF SAME

FIELD OF THE INVENTION

The invention relates generally to a toner supply container, and more particularly to a toner supply container that is switchable between an open and a close state by a pressing force, and applications of the same.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

In a conventional electrophotographic image forming apparatus such as an electrophotographic copying machine or a printer, fine particles toner is used as a developer. When the toner in the main assembly of the electrophotographic image forming apparatus is used up, the toner is supplied into the main assembly of the image forming apparatus using a toner supply container (a toner accommodating container).

Here, the electrophotographic image forming apparatus is an apparatus which forms images on a recording material through an electrophotographic image formation type process. The electrophotographic image forming apparatus includes a, an electrophotographic copying machine, an electrophotographic printer (laser beam printer, LED printer, for example), a facsimile machine, word processor or the like.

Since the toner is very fine powder, it is known to place, upon toner supplying operation, a toner supply container inside the main assembly of the image forming apparatus and to gradually supply the toner through a small opening to avoid scattering of the toner.

Any one of the above-described toner supply containers receives a driving force from the main assembly of an image forming apparatus to drive the toner supply container to discharge the toner. Various drive transmission methods are proposed for driving the toner supply container. However, the conventional structures involve some problems.

Therefore, a heretofore unaddressed need exists in the art to address the aforementioned deficiencies and inadequacies.

SUMMARY OF THE INVENTION

In one aspect, the invention relates to a toner supply container. In one embodiment, the toner supply container includes a container body, a releasing mechanism, and a sealing member.

The container body has a first end surface and an opposite, second end surface defining an inner space therebetween for accommodating the toner, a main body portion, a first portion extending from the main body portion in a first direction that is along a longitudinal axis of the container body and toward the first end surface, and a second portion extending from the first portion in the first direction.

The releasing mechanism includes a first plate, at least one pair of retaining plates, an elastic member, a releasing member, a engage member and a hook member. The first plate is attached to an outer surface of the second portion, and has a groove and an island surrounded by the groove. The at least one pair of retaining plates is attached to the outer surface of the second portion. The elastic member is located between the at least one pair of retaining plates. The releasing member has a releasing portion and a protrusion portion. The releasing portion is slidably sleeved on the second portion of the container body, and comprising an opening in fluid communication with the inner space of the container body, an urging section located at an inner side of the releasing portion that faces the first portion of the container body, and a second plate extending from the inner side of the releasing portion toward the first portion of the container body. Two ends of the elastic member urge against the first portion of the container 110 and the urging section of the releasing portion respectively. The protrusion portion extends from the releasing portion along the first direction. The engaging member has a base portion sleevably attached to the protrusion portion of the releasing member, and an engaging portion configured to receive a pressing force from a driving member of the apparatus. The hook member has a hook body, a first hook extending downward from a first end of the hook body, and slidably received in the groove, and a fixing portion extending upward from an opposite, second end of the hook body, and fixed to the second plate.

The sealing member is sleeved on the first portion, the second portion, and the releasing portion.

The groove has a first, a second, a third and a fourth groove portions. The first groove portion has a first free section, a first tail section and a first head section located between the first free section and the first tail section. The second groove portion has a second free section, a second tail section, and a second head section connected with the first tail section and located between the second free section and the second tail section. The third groove portion has a third head section connected with the second tail section, and a third tail section. The fourth groove portion has a third free section, a fourth tail section connected with the first head section, and a fourth head section connected with the third tail section and located between the third free section and the fourth tail section. The first tail section is higher than the second head section, the second tail section is higher than the third head section, the third tail section is higher than the fourth head section, and the fourth tail section is higher than the first head section, such that the first hook 164 is movable only from the first tail section to the second head section, from the second tail section to the third head section, from the third tail section to the fourth head section, and from the fourth tail section to the first head section. The island forms a notch inside the third groove portion, the notch is located between the third head section and the third tail section, and is configured to accommodate the first hook.

In one embodiment, at an initial (or close) state, the first hook is located at the notch of the island.

In one embodiment, when the toner supply container is installed to a receiving space of the apparatus, the engaging member is pressed by the pressing force to move toward the first end surface, the engaging member subsequently presses the releasing member, the urging portion of the releasing member presses the elastic member, the second plate presses the fixing portion, and the first hook is then moved from the notch to the third free section of the fourth groove portion, and then released to the fourth tail section of the fourth groove portion, such that the at least one opening of the releasing portion is exposed from the sealing member for releasing toner from the container body. This process is the transition of the toner supply container from the initial (close) state to the work (or open) state.

In one embodiment, when the engaging member is pressed again by the pressing force to move toward the first end surface, the engaging member subsequently presses the releasing member, the urging portion of the releasing member presses the elastic member, the second plate presses the fixing portion, and the first hook is then moved from the fourth tail section of the fourth groove portion to the second free section of the second groove portion, and then released to the notch of the island, such that the at least one opening of the releasing portion is closed by the sealing member. This process is the transition of the toner supply container from the work (open) state to the close state, such that the empty toner supply container can be removed.

In one embodiment, the island has a first acute portion aligning with the first head section, a second acute portion aligning with the second head section, and a third acute portion aligning with the fourth head section. In one embodiment, the second acute portion and the third acute portion are located at two sides of the notch.

In one embodiment, a width of the groove is slightly greater than a width of the first hook.

In one embodiment, a depth difference between each of the first tail section and the second head section, the second tail section and the third head section, the third tail section and the fourth head section, and the fourth tail section and the first head section, is much smaller than a depth of the groove.

In one embodiment, a part of the groove between the first head section and the first tail section is substantially curved, and a part of the groove between the fourth head section and the fourth tail section is substantially curved.

In one embodiment, each of the first, the second and the third free sections is substantially straight.

In one embodiment, a diameter of the plate portion is greater than a diameter of the releasing portion, and the diameter of the base portion is substantially the same as a diameter of the sealing member.

In one embodiment, a diameter of the urging section is greater than a diameter of the releasing portion, and the diameter of the urging section is smaller than a diameter of the sealing member.

In one embodiment, a number of the at least one pair of retaining plates is three, and correspondingly, a number of the elastic member is three, and the three pair of retaining plates are distributed evenly along a circumference of the outer surface of the second portion.

In another aspect, the present invention relates to a releasing mechanism usable for a toner supply container. In one embodiment, the releasing mechanism includes a groove, a releasing portion, and a hook member.

The groove is located at the toner supply container. The releasing portion is slidably fixable to the toner supply container, and has at least one opening for releasing toner from the toner supply container, and a fixing structure disposed over the groove for cooperating with the groove. The hook member is disposed between the groove and the fixing structure, and has a first hook slidably received in the groove, and a fixing portion fixable to the fixing structure. The releasing portion is configured to receive a first force pushing the releasing portion toward the toner supply container and a second force pushing the releasing portion away from the toner supply container. By operations of the first force and the second force, the first hook is configured to slide along the groove and is stoppable at a first position of the groove close to the toner supply container and a second position of the groove away from the toner supply container, such that the releasing portion is movable relative to the toner supply container to provide or to stop providing the toner.

In one embodiment, the releasing mechanism further includes an engage member fixed to the releasing portion, and configured to engage with an apparatus for receiving the first force. The releasing portion further has an urging section for receiving the second force.

In one embodiment, the releasing mechanism further includes an elastic member located between the releasing portion and the toner supply container, for providing the second force.

In one embodiment, after the releasing mechanism is attached to the toner supply container: if the first hook is located at the first position, the opening is configured to be not in fluid communication with an inner space of the toner supply container; and if the first hook is located at the second position, the opening is configured to be in fluid communication with the inner space of the toner supply container for providing the toner.

In one embodiment, the groove has a first, a second, a third and a fourth groove portion. The first groove portion has a first free section, a first tail section and a first head section located between the first free section and the first tail section. The second groove portion has a second free section, a second tail section, and a second head section connected with the first tail section and located between the second free section and the second tail section. The third groove portion has a third head section connected with the second tail section, and a third tail section. The fourth groove portion has a third free section, a fourth tail section connected with the first head section, and a fourth head section connected with the third tail section and located between the third free section and the fourth tail section. The first tail section is higher than the second head section, the second tail section is higher than the third head section, the third tail section is higher than the fourth head section, and the fourth tail section is higher than the first head section, such that the first hook is movable only from the first tail section to the second head section, from the second tail section to the third head section, from the third tail section to the fourth head section, and from the fourth tail section to the first head section. The groove surrounds an island, the island forms the first position inside the third groove portion, the first position is located between the third head section and the third tail section, and is configured to accommodate the first hook.

In one embodiment, at an initial state, the first hook is located at the first position.

In one embodiment, when the toner supply container is installed to a receiving space of an apparatus, and the releasing portion is pressed by the first force, the fixing structure moves the hook member such that the first hook is moved from the first position to the second position, and thus the opening is exposable for releasing toner from the container supply container. When the releasing portion is pressed again by the first force, the fixing structure moves the hook member such that the first hook is moved from the second position to the first position, and thus the opening is sealable to prevent the toner from being released.

These and other aspects of the present invention will become apparent from the following description of the embodiment taken in conjunction with the following drawings, although variations and modifications therein may be affected without departing from the spirit and scope of the novel concepts of the present invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
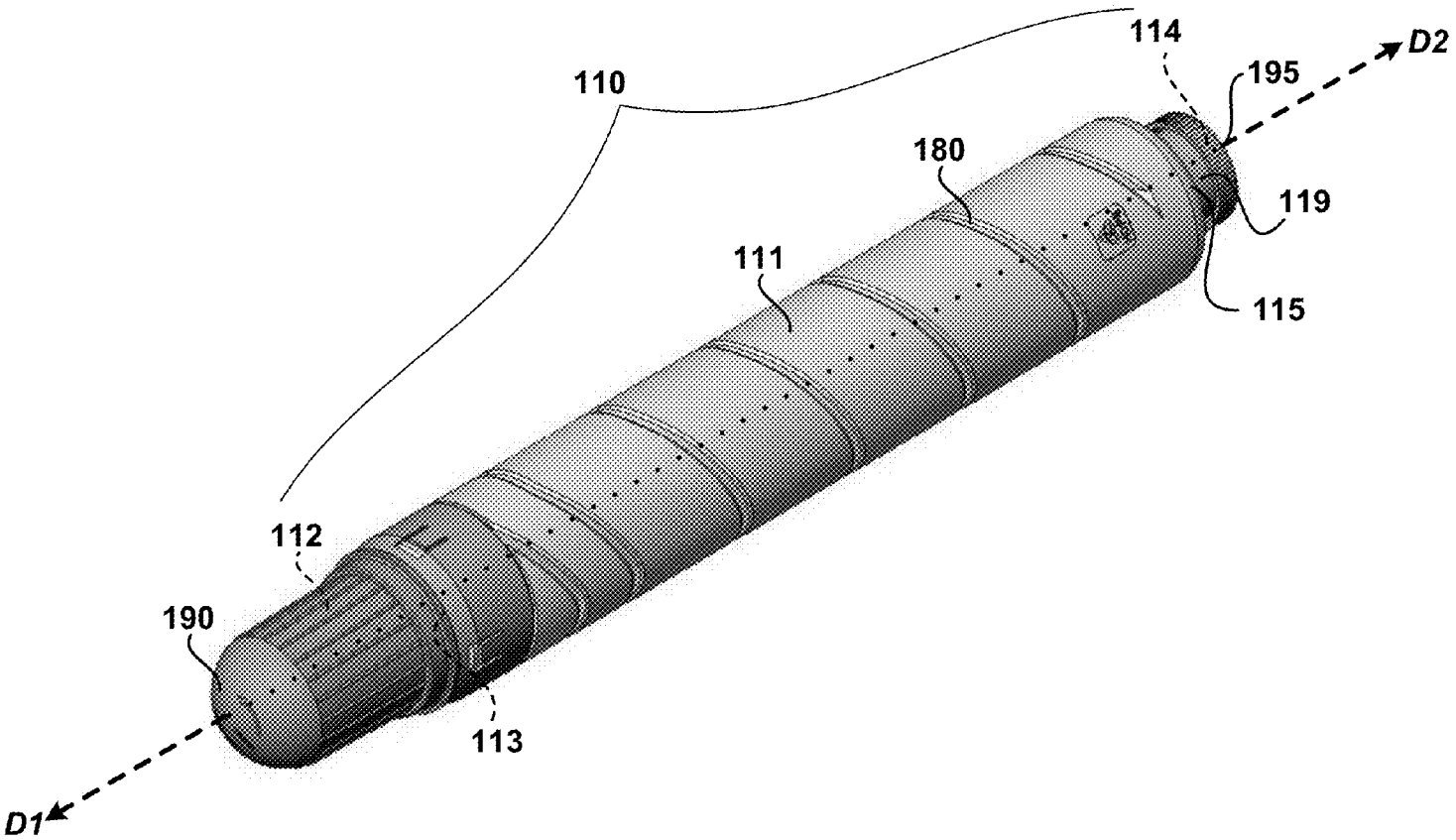
FIG. 1 schematically shows a three-dimensional view of a toner supply container according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the FIGS. It will be understood that relative terms are intended to encompass different orientations of the device in addition to the orientation shown in the FIGS. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate, meaning that the terms "around", "about", "substantially" or "approximately" can be inferred if not expressly stated.

As used herein, the terms "comprise" or "comprising", "include" or "including", "carry" or "carrying", "has/have" or "having", "contain" or "containing", "involve" or "involving" and the like are to be understood to be open-ended, i.e., to mean including but not limited to.

As used herein, the phrase "at least one of A, B, and C" should be construed to mean a logical (A or B or C), using a non-exclusive logical OR. It should be understood that one or more steps within a method may be executed in different order (or concurrently) without altering the principles of the invention.

The description will be made as to the embodiments of the invention in conjunction with the accompanying drawings. In accordance with the purposes of this invention, as embodied and broadly described herein, this invention, in one aspect, relates to a toner supply container and applications of the same.

Figure 2A:
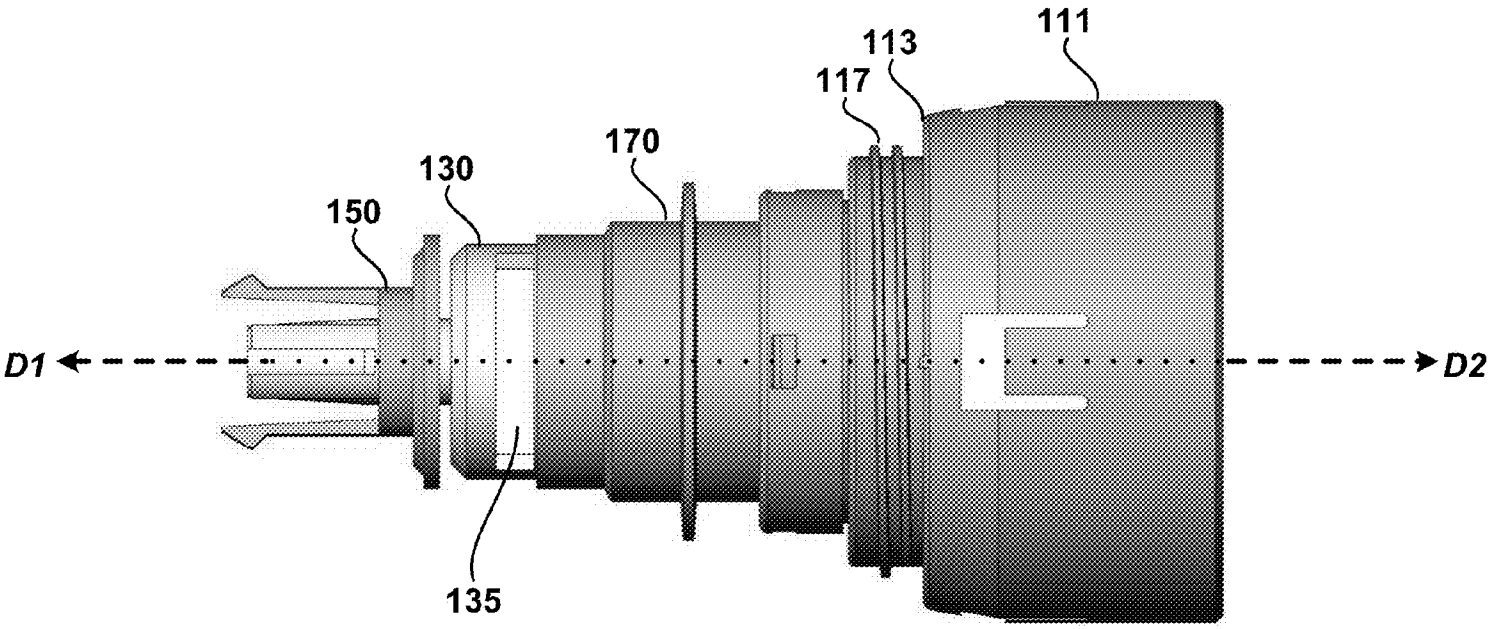
FIGS. 2A-2C schematically show views of a part of the toner supply container according to one embodiment of the invention from different angles, where the toner supply container is in an open state.

FIG. 1 schematically shows a three-dimensional view of a toner supply container according to one embodiment of the invention. As shown in FIG. 1, a toner supply container 100 includes a container body 110, a first cap 190 and a second cap 195. As shown in FIG. 2A, the toner supply container 100 further includes a releasing member 130, an engaging member 150, and a sealing member 170.

Referring back to FIG. 1, the container body 110 is basically in a shape of a cylinder, and has a first end surface 112 and a second end surface 114 opposite to the first end surface 112. The container body 110 has an axial along the longitudinal direction, and an radial direction located at the circular sectional plane of the cylinder. A direction D1 is defined as the direction from the second end surface 114 toward the first end surface 112, and a direction D2 is defined as the direction from the first end surface 112 toward the second end surface 114. The container body 110 defines an inner space between the first end surface 112 and the second end surface 114, for accommodating toner. In one embodiment, an outer surface of the container body 110 is concavely formed with a screw shaped groove 180 along the container body 110. When the container body 110 is rotated, the screw shaped groove 180 is configured to move the toner inside the container body 110 along the D1 direction.

Figure 11A:
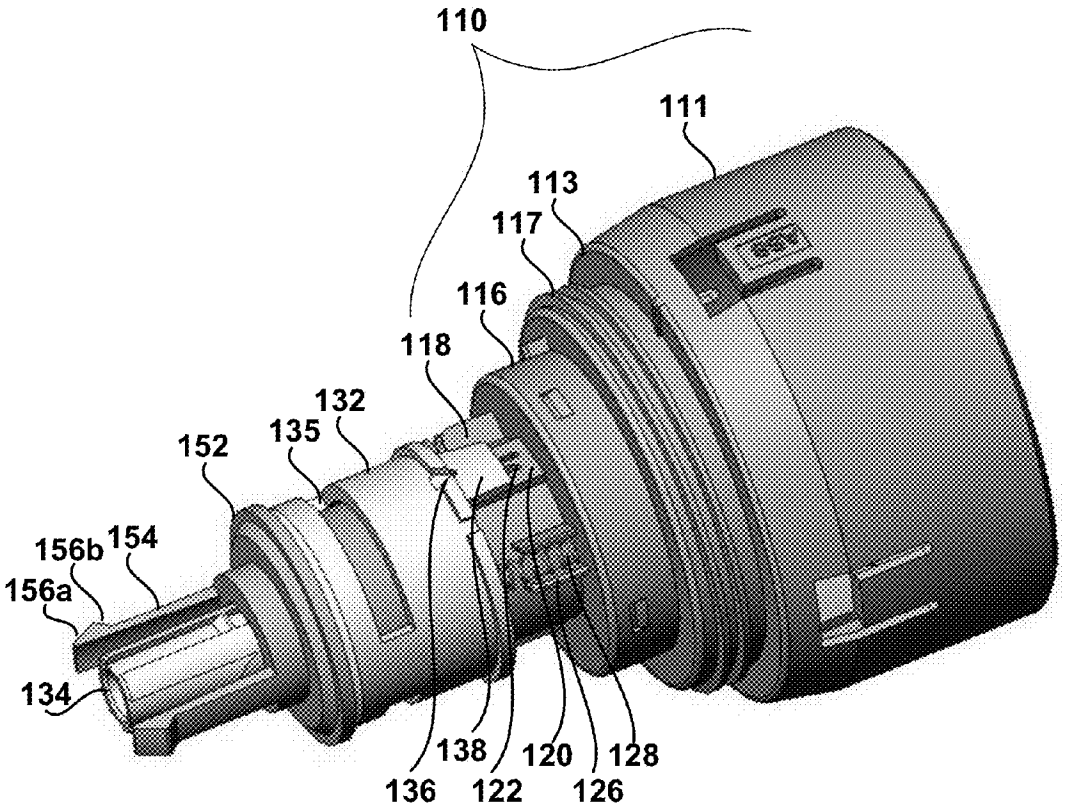
FIGS. 11A-11B schematically show a three-dimensional view of a part of the toner supply container in the close state according to one embodiment of the present invention, where the sealing member is hide to shown the inner structure.

The container body 110 has a main body portion 111. The main body portion 111 has a third end surface 113 close to the first end surface 112, and a fourth end surface 115 close to the second end surface 114. As shown in FIG. 11A, the main body portion 111 extends in the D1 direction from the third end surface 113 to form a first capping portion 117 matable with the first cap 190. The first capping portion 117 is in a cylindrical shape. A diameter of the first capping portion 117 is slightly smaller than a diameter of the main body portion 111. In certain embodiments, an outer surface of the first capping portion 117 is threaded, and an inner surface of the first cap 190 is threaded, such that the first cap 190 is fixable to the first capping portion 117 by screwing. A diameter of the opening of the first cap 190 is substantially the same as the diameter of the main body portion 111, such that when the first cap 190 is screwed onto the first capping portion 117, an end surface at the opening of the first cap 190 urges the third end surface 113 of the main body portion 111.

Referring back to FIG. 1, the fourth end surface 115 extends in the D2 direction to form a second capping portion 119. A diameter of the second capping portion 119 is much smaller than the diameter of the main body portion 111 or the first capping portion 117. A free end of the second capping portion 119 is threaded at the outer surface, the second cap 195 is threaded at the inner surface, such that the second cap 195 is fixable to the second capping portion 119 by screwing. When the second cap 195 is screwed on the second capping portion 119, the second cap 195 contacts the second surface 114.

In one embodiment, each of the first cap 190 and the second cap 195 is screwed to the first capping portion 117 and the second capping portion 119 respectively. In other embodiments, each of the first cap 190 and the second cap 195 may be fixable to the first capping portion 117 and the second capping portion 119 by other means, for example, press fitting.

As shown in FIG. 11A, the first capping portion 117 extends in the D1 direction to form a first portion 116. The first portion 116 may have a cylindrical shape, and a diameter of the first portion 116 is smaller than the diameter of the first capping portion 117.

The first portion 116 extends in the D1 direction to form a second portion 118. The second portion 118 may have a cylindrical shape, and a diameter of the second portion 118 is smaller than the diameter of the first portion 116.

A first plate 120 is disposed on an outer surface of the second portion 118. In one embodiment, the first plate 120 is in a rectangular shape having a top surface, a bottom surface, and four side surfaces. The bottom surface of the first plate 120 is attached to the outer surface of the second portion 118. One of the four side surfaces of the first plate 120 is in contact with the end surface of the first portion 116. Two other parallel side surfaces of the first plate 120 are substantially parallel to the longitudinal axial of the container body 110. The first plate 120 is concavely formed with a groove 122 from the top surface downward. The groove 122 may or may pass through the first plate 120, as long as the groove 122 has a certain depth to achieve its function. The groove 122 surrounds an island 124.

In this embodiment, the groove 122 is formed on the first plate 120. In other embodiments, the toner supply container 100 may not include the first plate 120. In one embodiment, the groove 122 may be formed on another type of structure other than the first plate 120. In one embodiment, the groove 122 may be formed directly on the outer surface of the second portion 118. The structure of the first plate 120 and the groove 122 are not limited to the above described embodiments, as long as there is a groove 122 for retaining the first hook 162 of the hook member 160, such that the first hook 162 is slidably movable in the groove 122.

Figure 4:
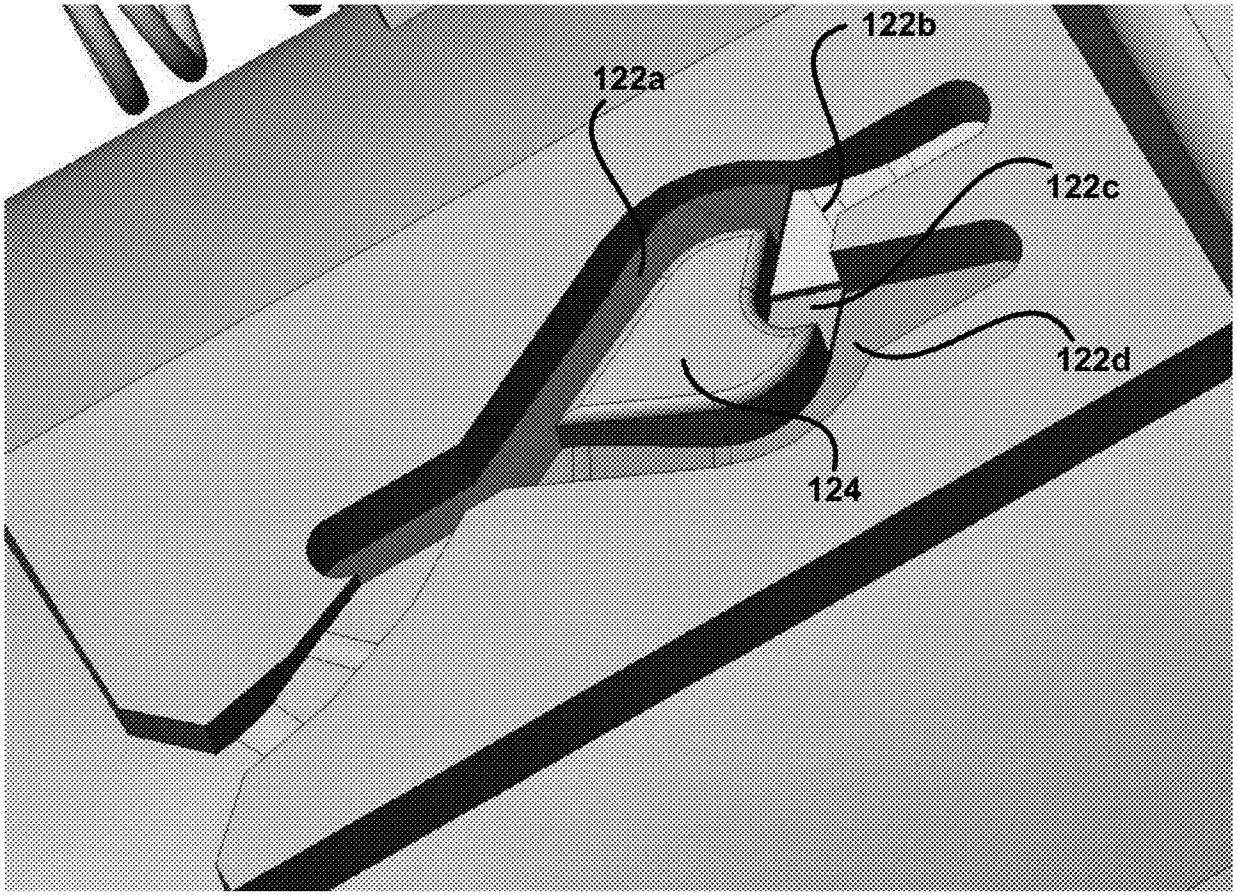
FIG. 4 schematically shows a three-dimensional view of a groove of the toner supply container according to one embodiment of the present invention.

As shown in FIG. 4, in certain embodiments, the groove 122 basically surrounds a heart shaped island 124. In addition, the groove 122 further includes two rabbit ear shaped protrusions from above the heart shaped island 124, and one substantially straight extension from below the heart shaped island 124.

Specifically, the groove 122 includes a first groove portion 122*a*, a second groove portion 122*b*, a third groove portion 122*c*, and a fourth groove portion 122*d*. The first groove 122*a* has a first free section, a first tail section, and a first head section located between the first free section and the first tail section. The second groove portion 122*b* has a second free section, a second tail section, and a second head section connected with the first tail section and located between the second free section and the second tail section. The third groove portion 122*c* has a third head section connected with the second tail section, and a third tail section. The fourth groove portion 122*d* has a third free section, a fourth tail section connected with the first head section, and a fourth head section connected with the third tail section and located between the third free section and the fourth tail section. The first free section is the straight extension described above, and the second free section and the third free section are the rabbit ear shaped protrusions. In one embodiment, the top of the heart, the second free section, and the third free section face toward the outer end surface of the first portion 116, and the first free section extend outward longitudinally toward the releasing member 130 or the engaging member 150.

The first tail section is higher than the second head section, the second tail section is higher than the third head section, the third tail section is higher than the fourth head section, and the fourth tail section is higher than the first head section, such that the first hook 164 is movable only from the first tail section to the second head section, from the second tail section to the third head section, from the third tail section to the fourth head section, and from the fourth tail section to the first head section. The island 124 forms a notch inside the third groove portion 122*c* and located between the third head section and the third tail section, for accommodating the first hook 164.

One or more pairs of retaining plates 126 are disposed on the outer surface of the second portion 118. In one embodiment, each of the retaining plates 126 has an upper surface and a lower surface opposite to each other, and four side surfaces. The retaining plate 126 is attached to the outer surface of the second portion 118 by a bottom side surface of the four side surfaces only, and the bottom side surface is parallel to the longitudinal axis of the container body 110. The other one of the four side surfaces, adjacent to the bottom side surface, is attached to the end surface of the first portion 116. The upper and lower surfaces of the retaining plate 126 are substantially perpendicular to the outer surface of the second portion 118. In certain embodiments, the number of the retaining plates 126 pairs is two or more, and the two or more pairs of the retaining plates 126 are distributed evenly around the outer surface of the second portion 118.

The distance between two retaining plates 126 of a pair is slightly greater or the same as a diameter of an elastic member 128, and the elastic member 128 is retained between the one pair of the retaining plates 126. One end of each elastic member 128 urges against the end surface of the first portion 116. In one example, there are three pairs of retaining plates 126, and three elastic members 128 are retained in the three pairs of retaining plates 126 respectively. In one embodiment, the elastic members 128 are springs.

The retaining structure for retaining the elastic member 128 may not be the retaining plates 126 as described above. In certain embodiments, the retaining structure may be a protrusion or a rib projected from the outer surface of the second portion 118. In one embodiment, the retaining structure may be a recess formed on the outer surface of the second portion 118. The retaining structure for retaining the elastic member 128 is not limited to the retaining plates 126, the protrusion, the rib, or the recess, as long as the retaining structure is configured to hold the elastic member 128 in place.

Figure 6A:
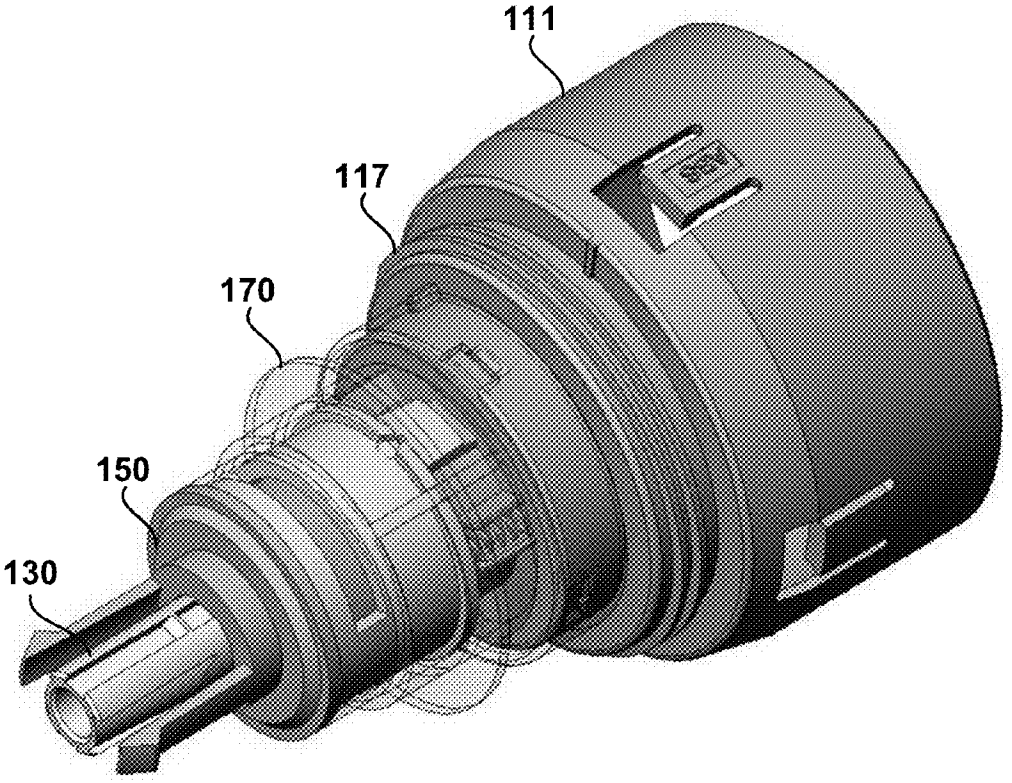
FIG. 6A schematically shows the three-dimensional view of FIG. 5, where a sealing member is shown as transparent according to one embodiment of the present invention.
Figure 6B:
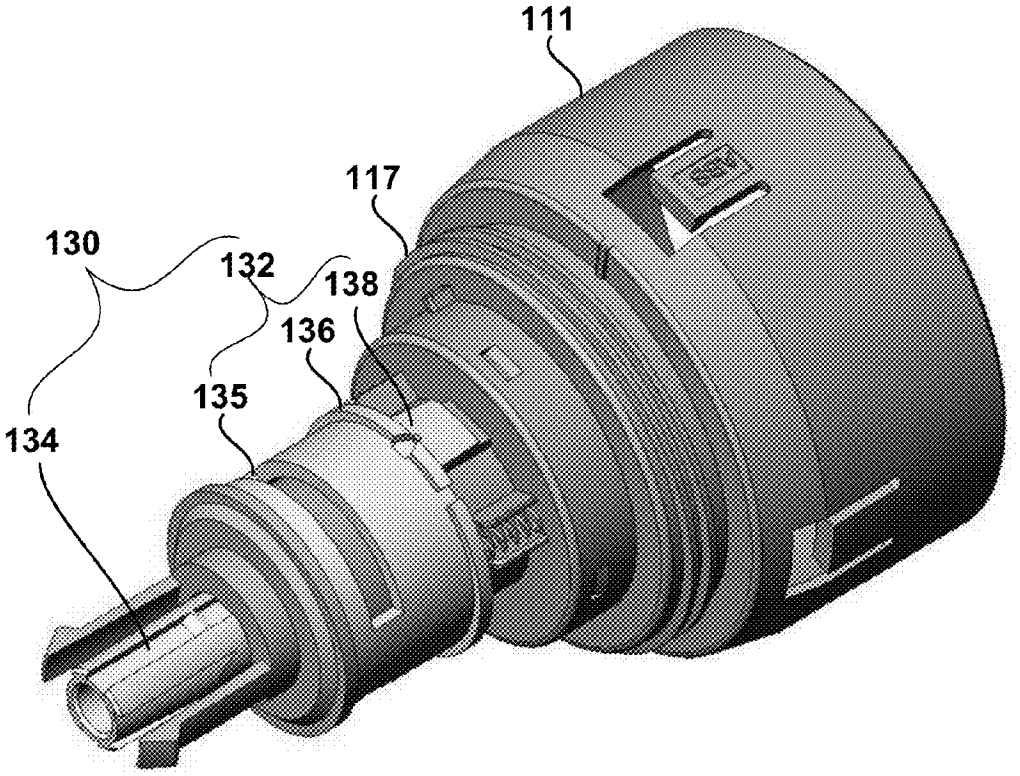
FIG. 6B schematically shows the three-dimensional view of FIG. 5, where a sealing member is hidden to show the structure inside the sealing member according to one embodiment of the present invention.

As shown in FIG. 6B, the toner supply container 100 further includes a releasing member 130. The releasing member 130 includes a releasing portion 132 sleeved on the second portion 118 and a protrusion portion 134 extending from the releasing portion 132 in the D1 direction. The releasing portion 132 is slidable, and has at least one opening 135, an urging section 136, and a second plate 138.

The releasing portion 132 may have a cylindrical shape, and includes an inner surface facing the outer surface of the second portion 118, and an outer surface facing outwards towards the inner surface of the sealing member 170. A diameter of the releasing portion 132 is slightly greater than the diameter of the second portion 118, slightly smaller than corresponding part of the sealing member 170, and smaller than the diameter of the first portion 116. The releasing portion 132 is sleeved on the second portion 118, and is slidable along the longitudinal axial of the toner supply container 100. The releasing portion 132 is not completely overlap with the second portion 118. In other words, the length of the releasing portion 132 is shorter than the length of the second portion 118 along the longitudinal direction, there is a clearance or distance between the inner side of the toner releasing portion 132 and the end surface of the first portion 116, such that a part of the outer surface of the second portion 118 is exposable from the clearance.

The at least one opening 135 are formed on and through the releasing portion 132, and configured to release toner from the toner supply container 100 to a receiving portion of the apparatus (not shown).

The opening 135 is slidable together with the releasing portion 132 between the second portion 118 and the sealing member 170, in relative to the second portion 118 and the sealing member 170. The opening 135 is in fluid communication with the inner space of the container body 110 under working condition. At working or open condition, the opening 135 is moved out of the space between the second portion 118 and the sealing member 170, and the toner is able to be dispensed from the inner space of the container body 110, through the opening 135, and provided to the apparatus. At a close condition, the opening 135 is located completely between the second portion 118 and the sealing member 170, is blocked by the second portion 118 and the sealing member 170, and is not in communication with the inner space of the container body 110 anymore.

The urging portion 136 is located at the inner end of the releasing portion 132 that is close to the first portion 116. The urging portion 136 may have a ring shaped structure attached to the outer surface of the releasing portion 132 at the inner end, or the urging portion 136 is part of the inner end of the releasing portion 132. In one embodiment, one end of the elastic member 128 urges against the end surface of the first portion 116, and the other end of the elastic member 128 urges against the urging portion 136 of the releasing portion 132.

The second plate 138 extends from the inner side of the releasing portion 132 at the inner end. In one embodiment, the second plate 138 covers on the first plate 120 and partially overlaps with the first plate 120 when viewing from outside of the toner supply container 100 radially. In certain embodiments, the second plate 138 is movable relative to the first plate 120. In certain embodiments, the second plate 138 has a through hole.

The protrusion portion 134 extends from the releasing portion 132 in the D1 direction. The protrusion portion 134 is configured to receive a driving force, such as a pressing force, from the apparatus so as to switch the releasing portion 132 between the open state and the close state. The protrusion portion 134 may have a column or cylindrical shape. A diameter of the cylindrical protrusion portion 134 is much smaller than the diameter of the releasing portion 132. The diameter of the protrusion portion 134 may not be uniform. In one embodiment, the diameter of the protrusion portion 134 is gradually reduced along the D1 direction. In one embodiment, the protrusion portion 134 has one or more concaves in the outer surface, to slidably fix the engaging member 150 onto the protrusion portion 134.

Figure 3A:
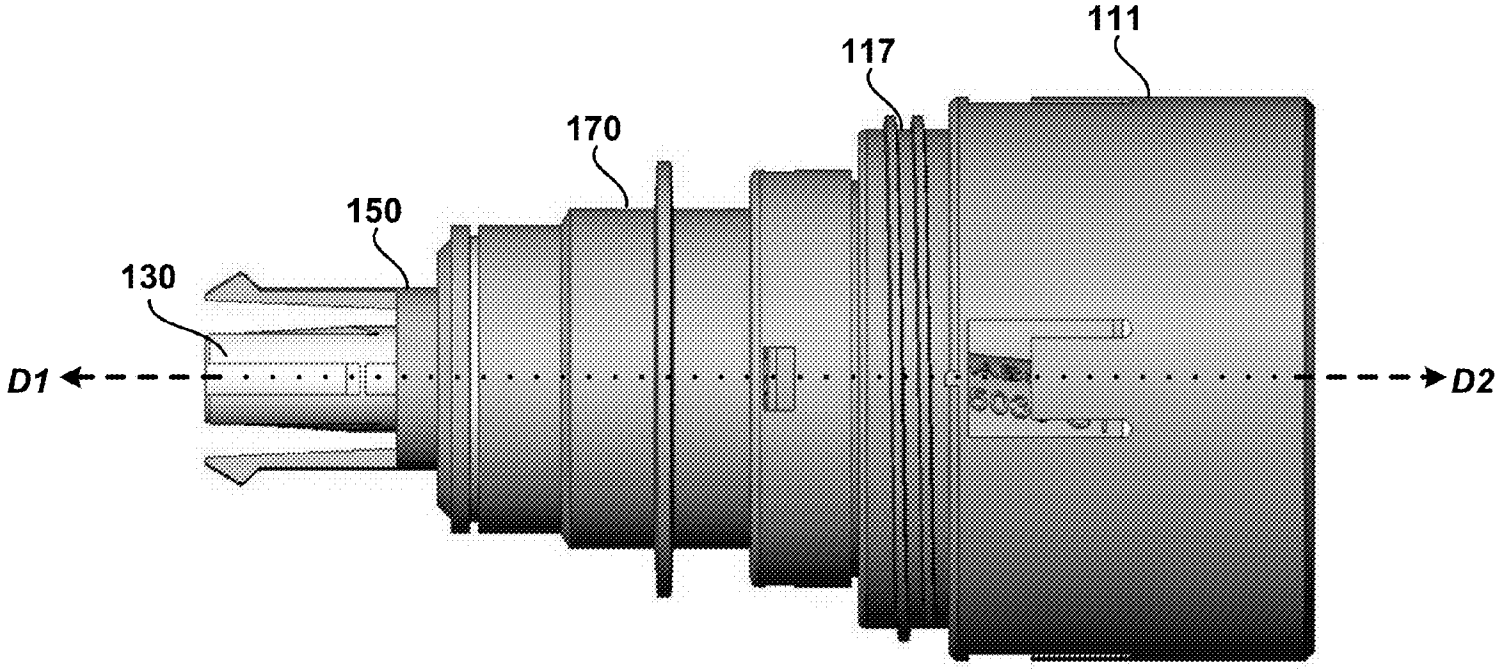
FIGS. 3A-3B schematically show views of a part of the toner supply container according to one embodiment of the invention from different angles, where the toner supply container is in a close state.
Figure 3B:
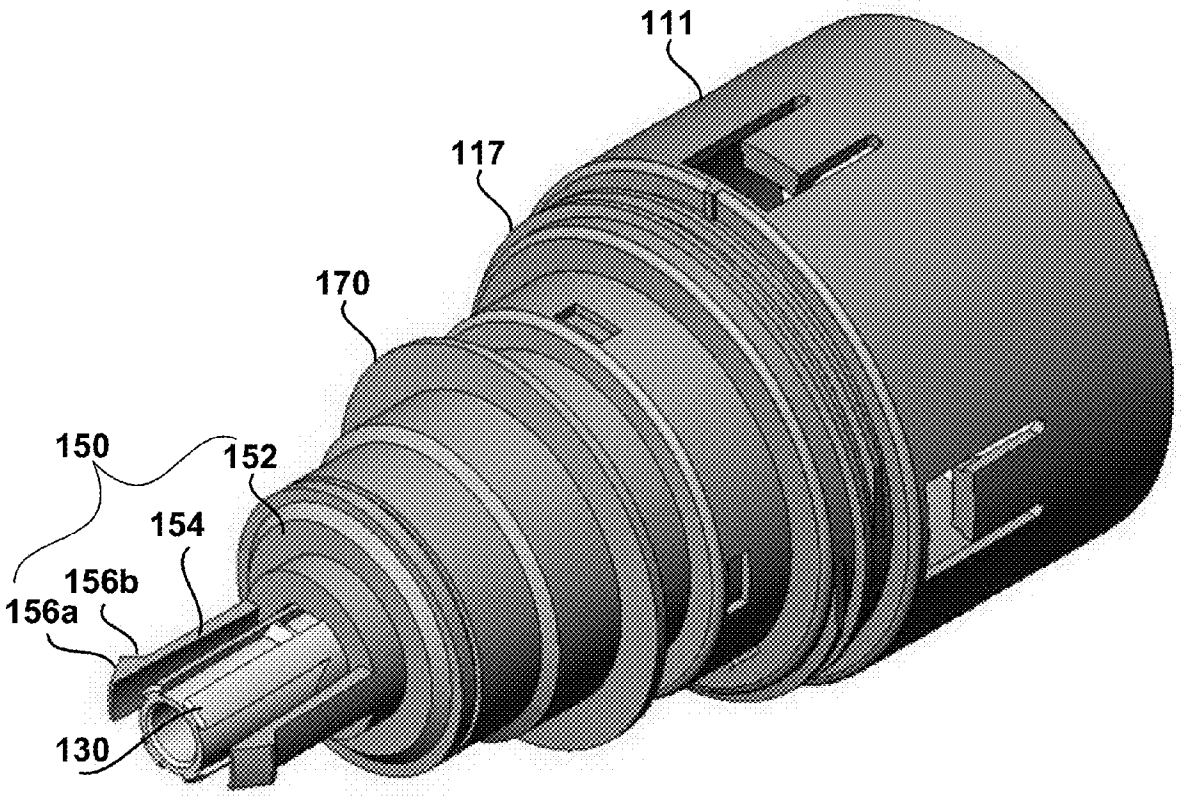

The toner supply container 100 further includes the engaging member 150 slidably attached to the releasing member 130. As shown in FIG. 3B, the engaging member 150 has a base portion 152 and an engaging portion extending from the base portion 152. The base portion 152 has a ring shape, the plane of the base portion 152 is in parallel to the outer end surface of the releasing portion 132. A diameter of the base portion 152 is greater than the diameter of the releasing portion 132, and substantially the same as the diameter at the outer end of the sealing member 170. During the pressing of the releasing member 130, the base portion 152 moves toward the outer end of the sealing member 170, and is stoppable by the outer end of the sealing member 170. The base portion 152 may include several ring shaped structures with different outer diameters and the same inner diameters. The engaging portion has two engaging sheets 154 extending from the base portion 152 and two engaging portions 156 projected from the free ends of the two engaging sheets radially outward respectively. The two engaging sheets 154 may be evenly distributed. In other words, the two engaging sheets 154 face to each other in relative to the axis of the toner supply container 100. Each of the two engaging portions 156 has a drive receive surface 156*a* for receiving the rotational driving force from the apparatus, and a locking surface 156*b* for snap-fit type locking The base portion 152 may have a ring shape, such that the protrusion portion 134 passes through the inner through hole of the ring shaped base portion 152. Outer surface of the protrusion portion 134 is provided with receiving slot, inner circumference of the through hole of the base portion 152 is provided with a protrusion, and the protrusion is received in the receiving slot to fix the engaging member 150 to the releasing member 130. The length of the receiving slot is greater than the length of the protrusion along the axis, such that the engaging member 150 is slightly slidable relative to the releasing member 130.

Figure 7A:
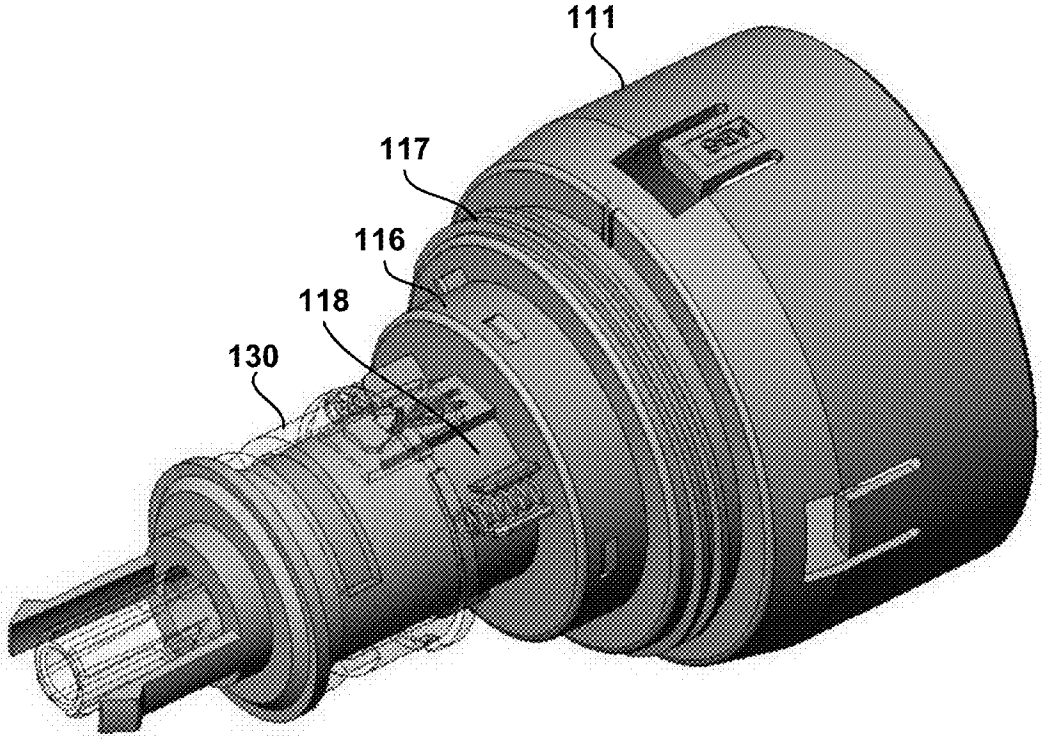
FIGS. 7A-7B schematically show a three-dimensional view of a part of the toner supply container in an initial (close) state according to one embodiment of the present invention, where a sealing member is shown as transparent.
Figure 7B:
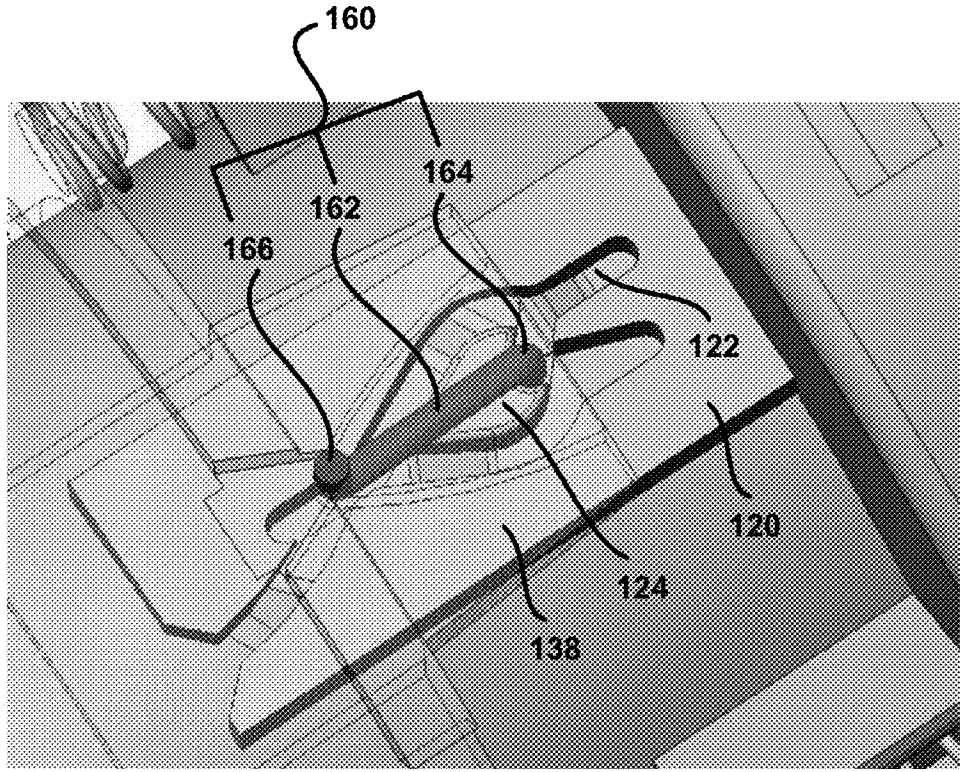

As shown in FIG. 7B, in certain embodiments, the toner supply container 100 further includes a hook member 160. The hook member 160 includes a straight hook body 162, a first hook 164 extending and bending downward from one end of the hook body 162, and a second hook 166 extending and bending upward from the other end of the hook body 162. The first hook 164 is movable in the groove 122 of the first plate 120, and the second hook 166 is fixed to the through hole of the second plate 138. In certain embodiments, the second hook 166 may have a structure other than a hook, as long as it can be fixed to the second plate 138. The second plate 138 correspondingly may not have the through hole, but have type of structures that cooperates with the fixing structure 166. In one embodiment, the fixing structure 166 may be a screw that can be screwed onto the second plate 138.

Referring back to FIG. 2A, the toner supply container 100 further includes the sealing member 170 sleeved on the first portion 116, the second portion 118, and part of the releasing member 130 Inner end surface of the sealing member 170 is close to and may be in contact with the end surface of the first capping portion 117, and outer end surface of the sealing member 170 flushes with the outer end surface of the second portion 118. As described above, the releasing portion 132 is located outside the second portion 118 and inside the sealing member 170, and is slidable between the second portion 118 and the sealing member 170. By the sliding of the releasing portion 132 between the space between the second portion 118 and the sealing member 170, the opening 135 can be exposed or concealed.

Figure 2B:
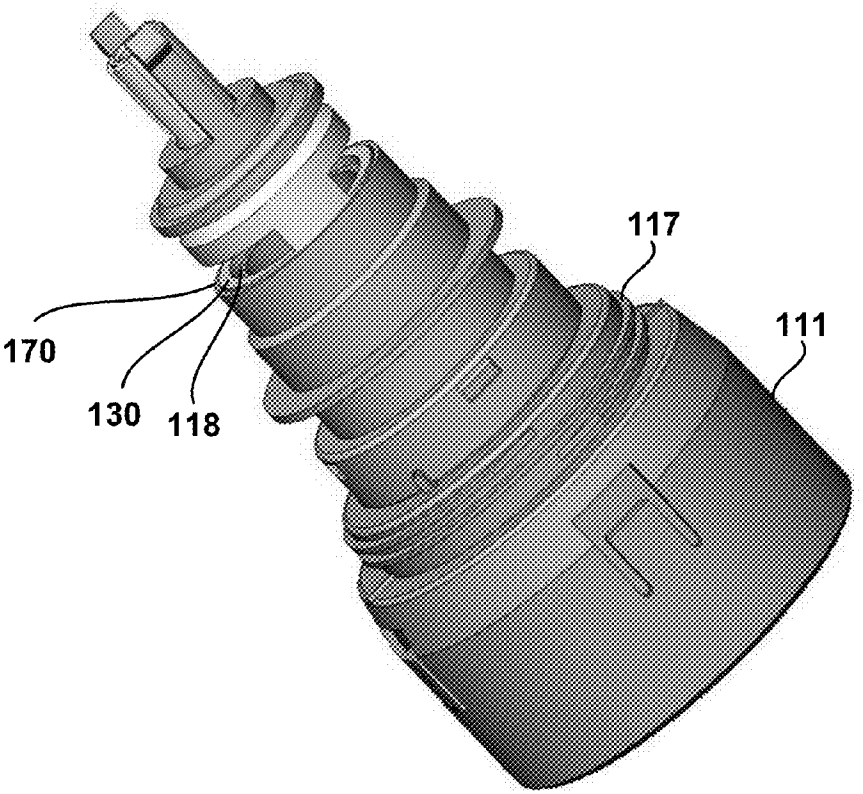
Figure 2C:
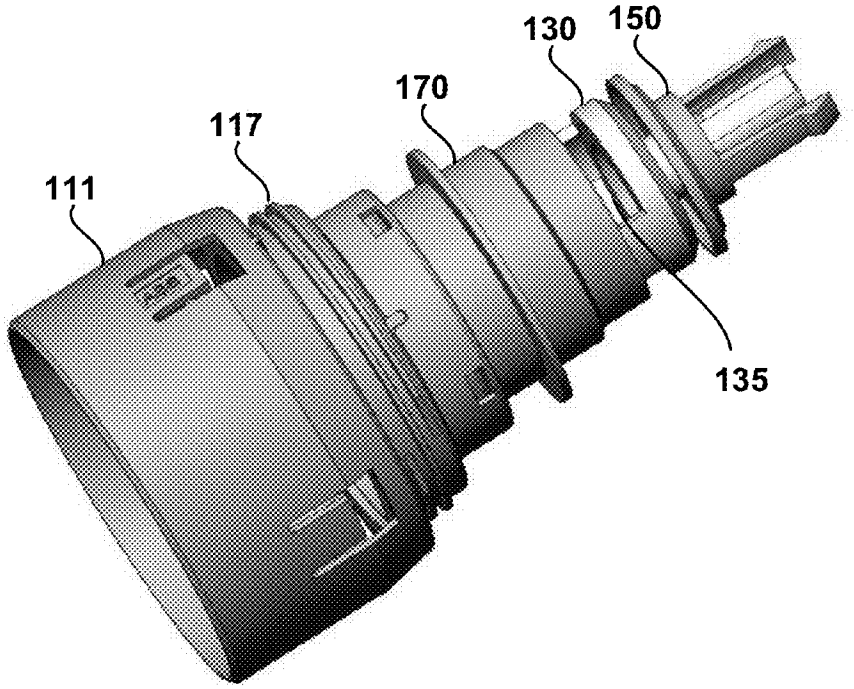

FIGS. 2A-2C schematically show different views of a part of the toner supply container 100 according to one embodiment of the invention, where the toner supply container 100 is in the open state for releasing toner. FIGS. 3A-3B schematically show different views of a part of the toner supply container 100 according to one embodiment of the invention, where the toner supply container 100 is in the close state. The toner supply container 100 is in the close state before being installed. After being installed, the toner supply container 100 is switched from the close state to the open state such that toner can be released or removed. When the toner is used up, the toner supply container 100 can be switched from the open state to the close state such that the toner supply container 100 can be removed from the apparatus for exchanging a new toner supply container.

When the toner supply container 100 is in the open state, as shown in FIGS. 2A-2C, the releasing member 130 is pushed outward by the elastic member 128 toward the D1 direction, such that the at least one opening 135 is exposed from the sealing member 170.

When the toner supply container 100 is in the close state, as shown in FIGS. 3A-3B, the releasing member 130 is pushed inward by a pressing force toward the D2 direction, such that the opening 135 is sealed between the second portion 118 and the sealing member 170. The pressing force may be a driving force from the apparatus.

In another aspect, the present invention is directed to a process of installation and releasing of the toner supply container described above to an apparatus. In certain embodiments, the operations of the toner supply container 100 are described in detail as follows.

Figure 5:
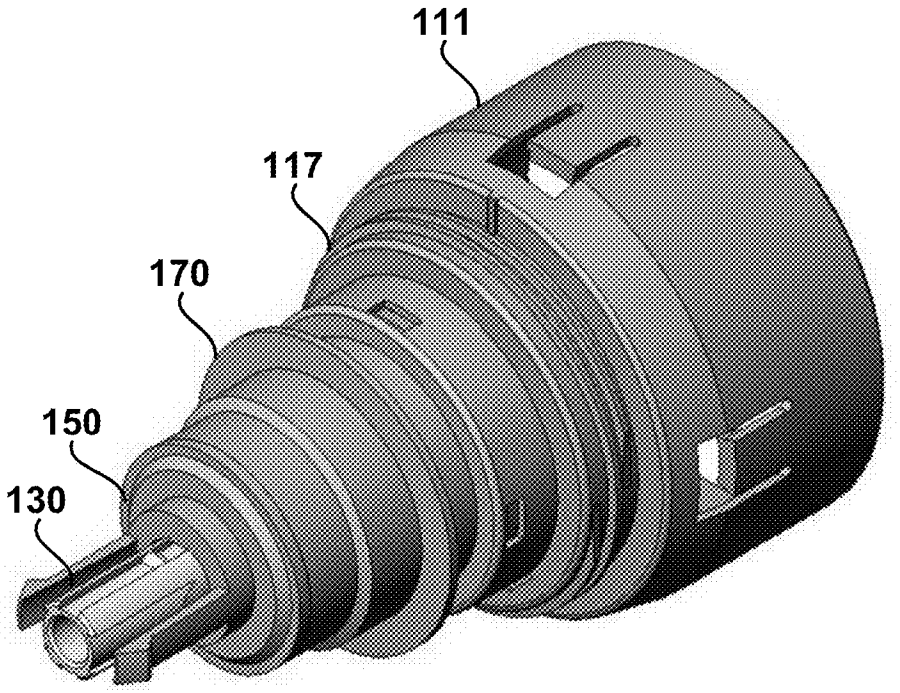
FIG. 5 schematically shows a three-dimensional view of a critical part of the toner supply container according to one embodiment of the present invention.

The description of the operations is focused on the part of the toner supply container 100 shown in FIG. 5. In order to clear show the operations, the sealing member 170 is shown as transparent in FIG. 6A, and the sealing member 170 is removed in FIG. 6B, such that the structures inside the sealing member 170 can be seen easily.

FIG. 7A shows a part of a brand new toner supply container 100, where the first cap 190 is removed, and the toner supply container 100 is placed into the apparatus. The releasing member 130 in FIG. 7A is shown as transparent to more clearly show the structure under it. This is the initial state or close state of the toner supply container 100. At this state, the releasing member 130 is in a retracted position toward the first portion 116, and the at least one window 135 are above the second portion 118. Thus, the opening 135 is closed by the second portion 118 from below the opening 135, and the opening 135 thus are not in fluid communication with the inner space of the toner supply container 100. As shown in FIG. 7B, the retracted position of the releasing member 130 is maintained through the hook member 160, where the first hook 164 is located at the notch of the island 124 and fixed therein. The one or more elastic members 126 are in a pressed condition.

Figure 8A:
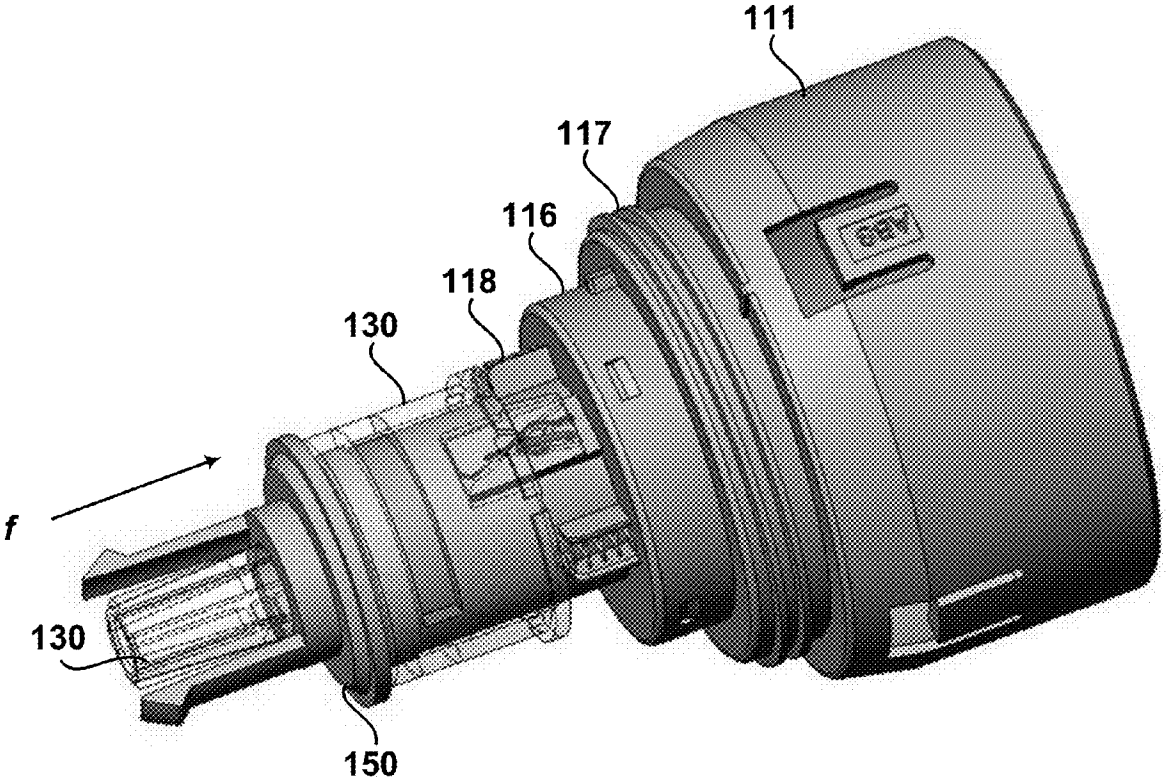
FIGS. 8A-8B schematically show a three-dimensional view of a part of the toner supply container in a transitional state from the initial state to a work (open) state according to one embodiment of the present invention, where the sealing member is shown as transparent.
Figure 8B:
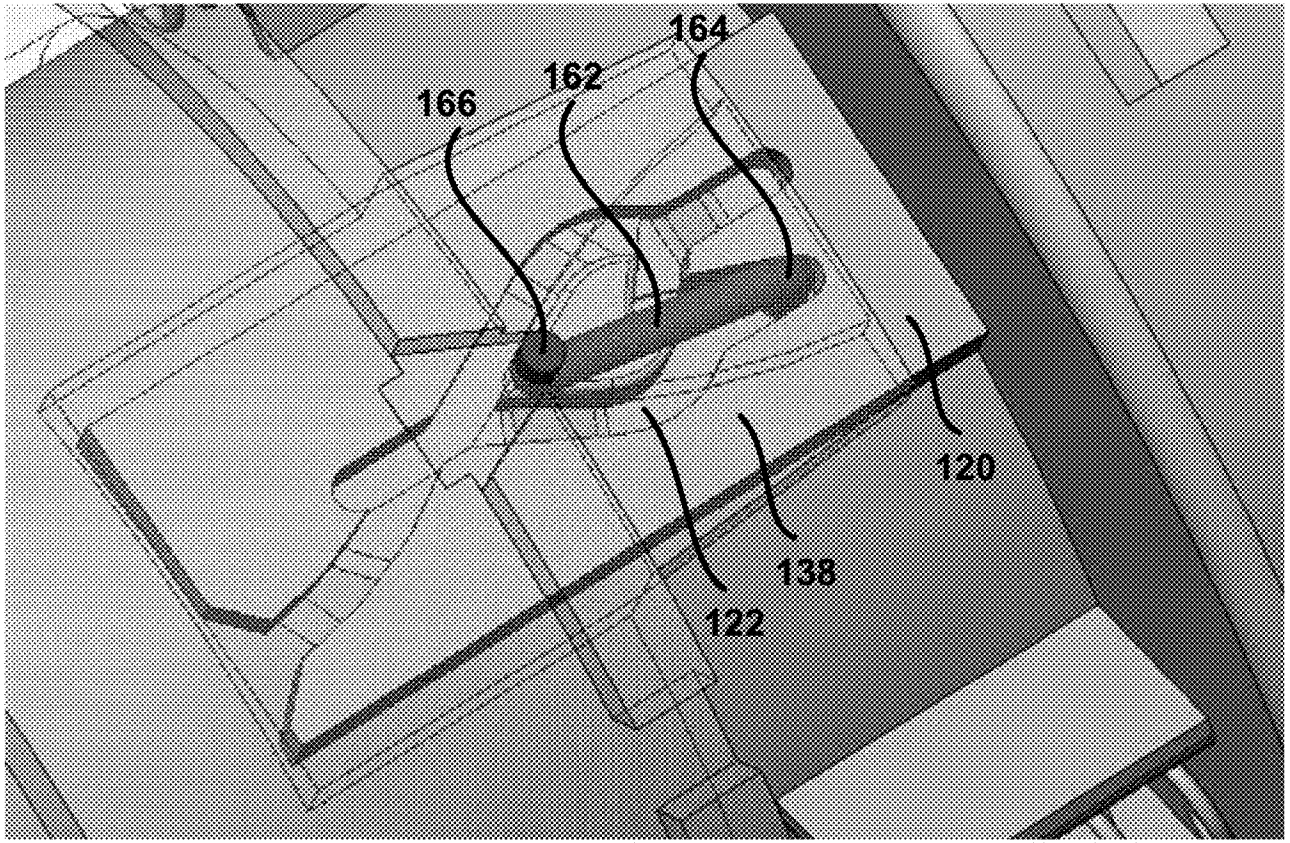

FIGS. 8A-8B show a transition state from the initial (close) state to the work state. When a hopper (not shown) of the apparatus is protruded along the arrow direction to press the engaging member 150 using a force f, the engaging member 150 moves along the D2 direction toward the first portion 116, and the movement of the engaging member 150 subsequently pushes the releasing member 130 to move along the D2 direction toward the first portion 116 as well. The movement of the releasing member 130, specifically the second plate 138, drives the second hook 166. Then the first hook 164, by the driven force of the second hook 166, slides into the third groove portion 122*c* from the notch, passes the third tail section, and enters through the fourth head section to the fourth groove portion 122*d*, and further moves toward the top end of the third free section. At the same time, the elastic member 128 is pressed at this transition state.

Figure 9A:
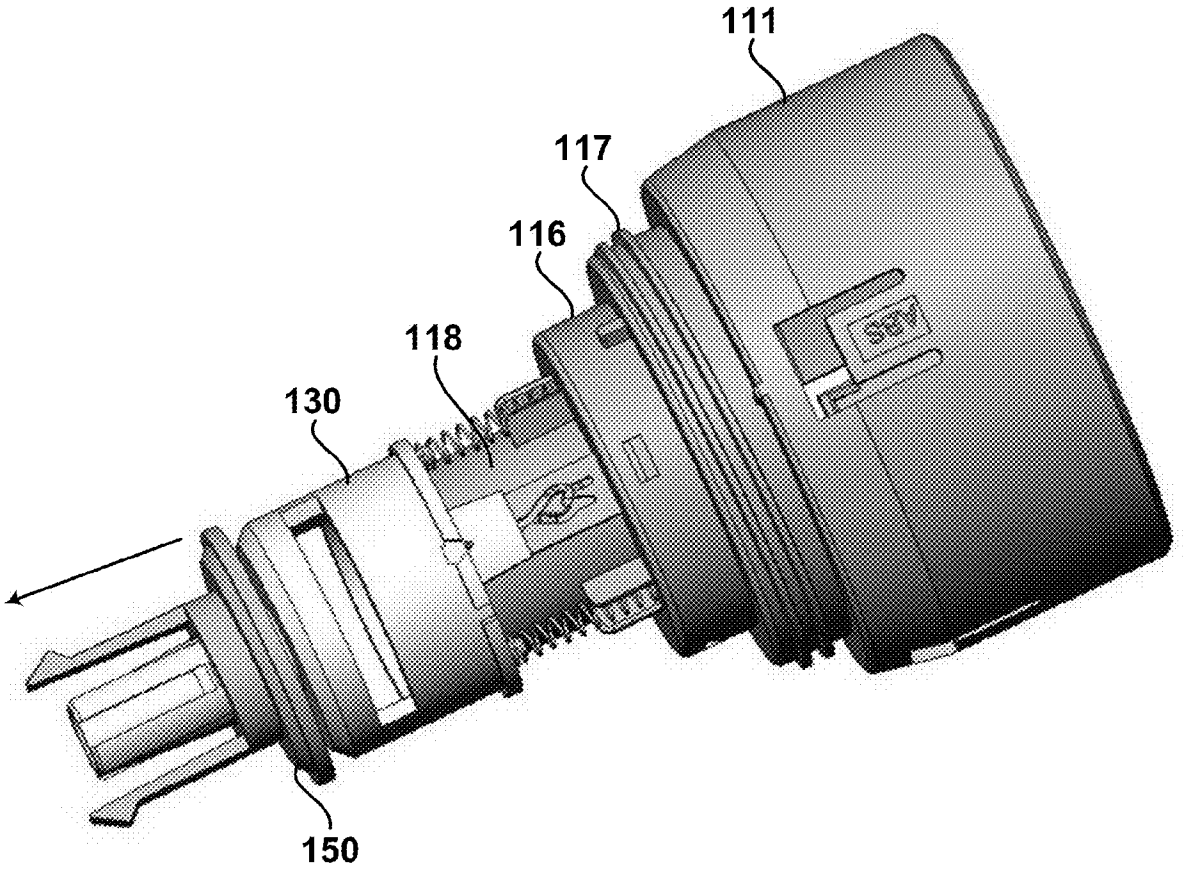
FIGS. 9A-9B schematically show a three-dimensional view of a part of the toner supply container in the work state according to one embodiment of the present invention, where the sealing member is shown as transparent.
Figure 9B:
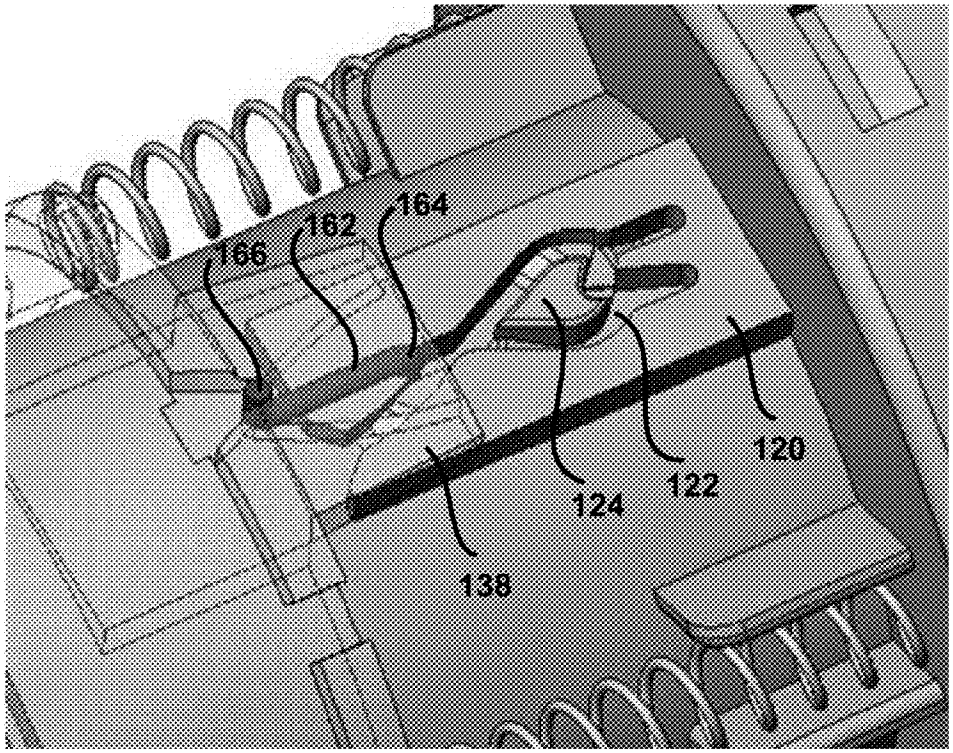

FIGS. 9A-9B show the open or work state of the toner supply container 100 achieved following the above described transition process. The pressing force f from the hopper shown in FIG. 8A is removed. With the releasing of the pressing force f from the hopper, the elastic member 128 pushes back the releasing member 130 outward in the D1 direction, away from the first portion 116. During this process, the first hook 164 slides in the fourth groove portion 122*d* from the top end of the third free section downward, passes the fourth head section and the fourth tail section, then enters from the first head section to the first groove portion 122*a*, and further moves toward the bottom end of the first free section that is most distant from the first portion 116. At this time, the elastic member 126 is in a most extended state, the releasing member 130 is pushed most outwards in the D1 direction to expose the at least one opening 135 from the second portion 118 and the sealing member 170. The opening 135 is in fluid communication with the inner space of the toner supply container. The toner supply container 100 is at the open or work state, and the toner is provided from the opening 135 to the apparatus.

Figure 10A:
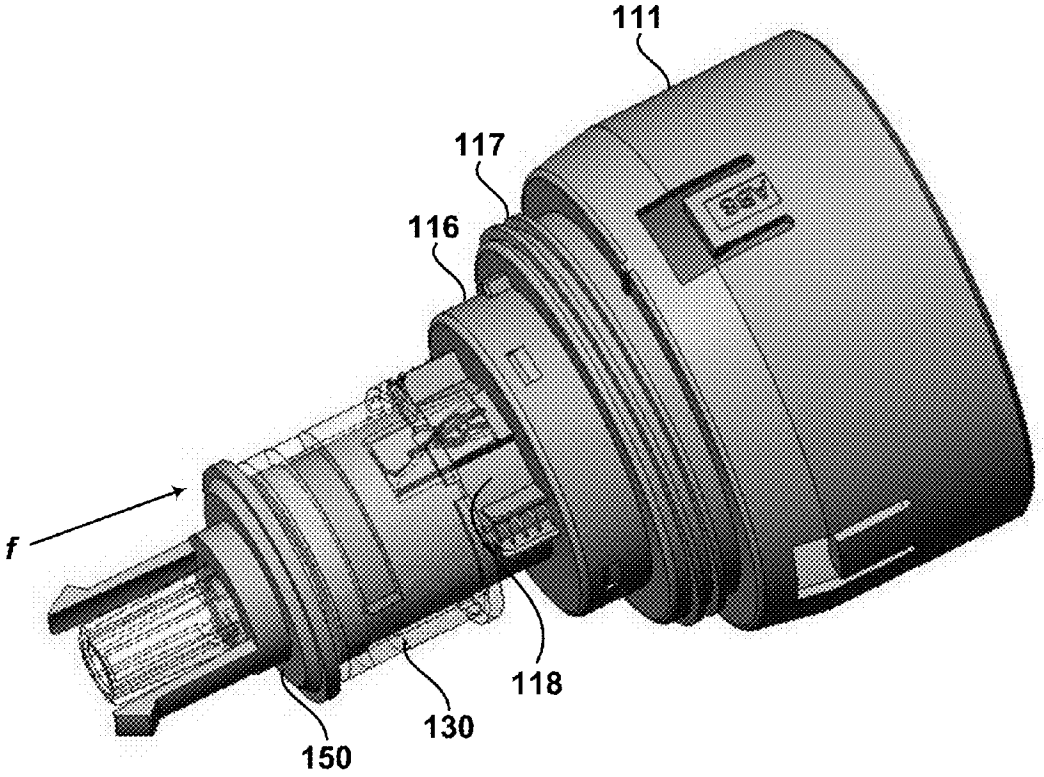
FIGS. 10A-10B schematically show a three-dimensional view of a part of the toner supply container in a transitional state from the work (open) state to a close state according to one embodiment of the present invention, where the sealing member is shown as transparent.
Figure 10B:
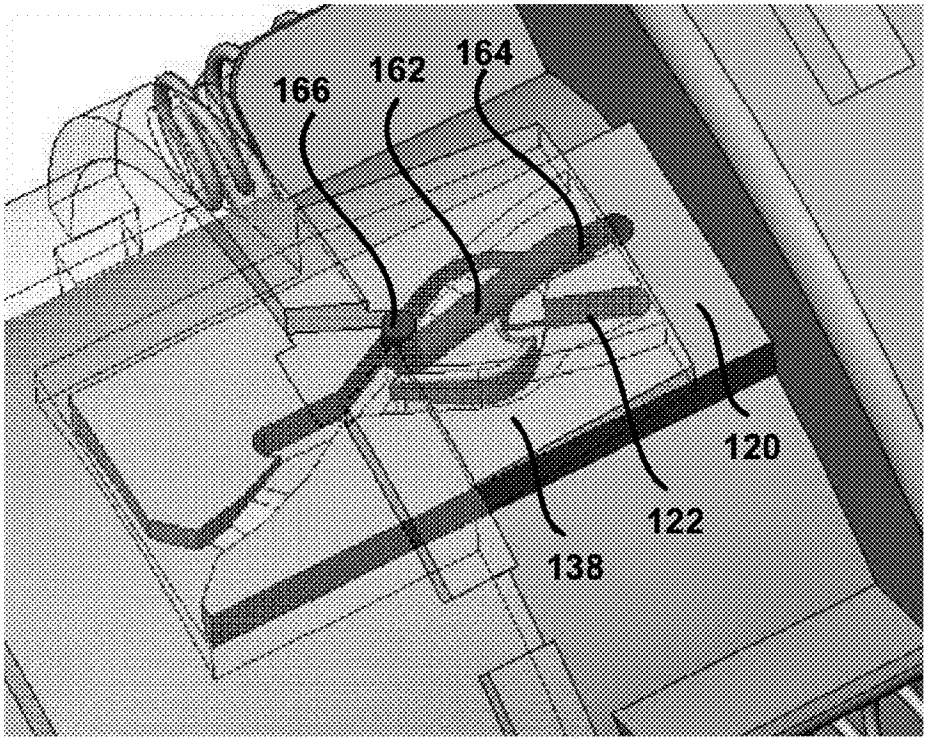

After the toner is used up, exchanging of the toner supply container 100 by a new toner supply container is required. In order to achieve this purpose, the toner supply container 100 need to be released from the apparatus and removed from the apparatus. FIGS. 10A-10B show a transition state from the work state to the close state. When the hopper (not shown) of the apparatus is protruded along the D2 direction to press the engaging member 150, the engaging member 150 moves along the D1 direction toward the first portion 116, and the movement of the engaging member 150 subsequently pushes the releasing member 130 to move along the D1 direction as well toward the first portion 116. The movement of the releasing member 130, specifically the second plate 138, drives the second hook 166. Then the first hook 164, moved by the driven force of the second hook 166, slides into the first groove portion 122*a* from the first free section, passes the first head section, and enters through the first tail section to the second groove portion 122*b*, and further moves toward the top end of the second free section that is close to the first portion 116. At this transition state, the elastic member 128 is pressed. Depending on the pressing force, the movement of the first hook 164 in the second groove portion 122*b* may be varies. However, the pressing force should be at least sufficient to move the first hook 164 passing through the first tail section of the first groove portion 122*a* to the second head section of the second groove portion 122*b*.

Figure 11B:
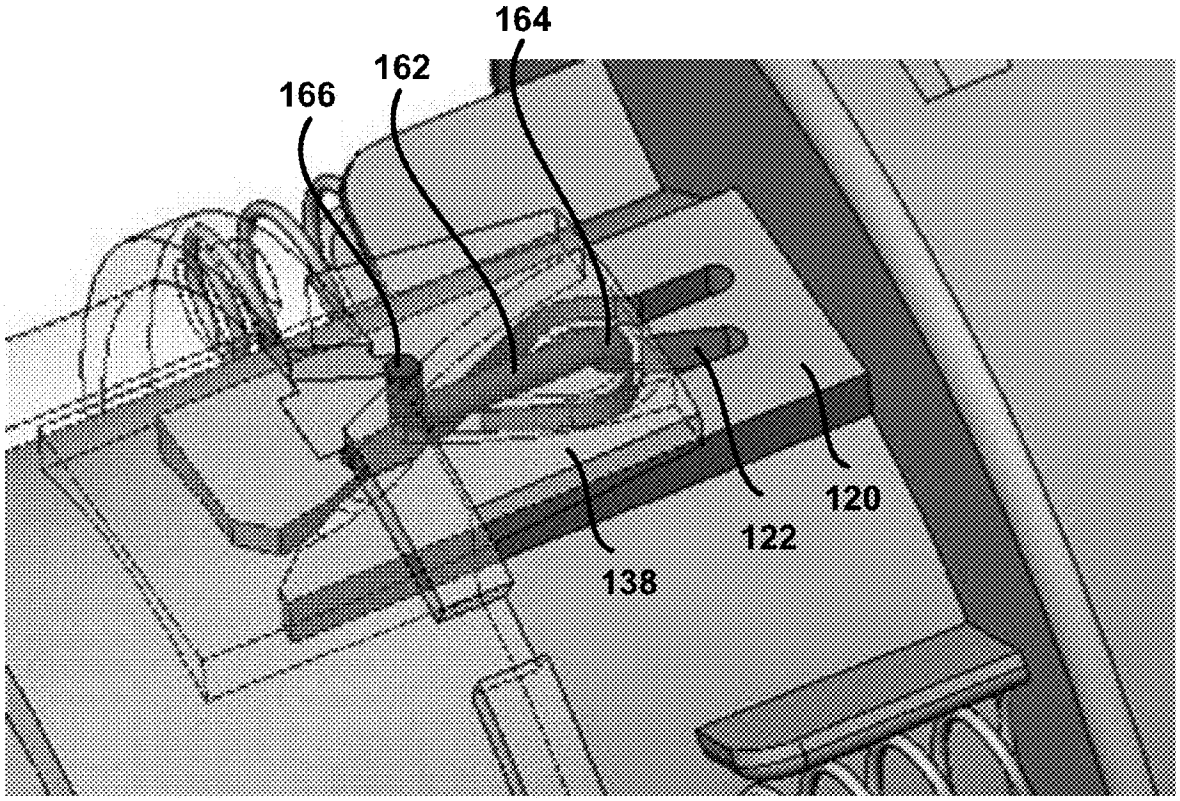

FIGS. 11A-11B show the close state of the toner supply container 100 achieved after the above described transition process. After releasing of the pressing force by the hopper of the apparatus, the elastic member 128 pushes the urging portion 136 and thus moves the releasing member 130 back toward the D1 direction, which accordingly moves the hook 160 back toward the D1 direction. The pressing force from the hopper shown in FIG. 10A is removed. With the releasing of the pressing force f from the hopper, the elastic member 128 pushes back the releasing member 130 outward along the D1 direction. During this process, the first hook 164 slides into the second groove portion 122*b* from the top end of the second free section downward, passes the second head section and the second tail section, then enters from the second tail section to the third groove portion 122*c*, and further moves toward the notch of the island 124. At this time, the toner supply container 100 is at the close state, and is ready to be removed from the apparatus.

After removing the used toner supply container 100, a new supply toner container can be installed and turned to work state according to the process shown in FIGS. 7A-9B as described above.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

Some references, which may include patents, patent applications, and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

What is claimed is:

1. A toner supply container for supplying toner to an apparatus, comprising:

a container body having a first end surface and an opposite, second end surface defining an inner space therebetween for accommodating the toner, a main body portion, a first portion extending from the main body portion in a first direction that is along a longitudinal axis of the container body and toward the first end surface, and a second portion extending from the first portion in the first direction;

a releasing mechanism, comprising:

a first plate attached to an outer surface of the second portion, and having a groove and an island surrounded by the groove;

at least one pair of retaining plates attached to the outer surface of the second portion;

an elastic member located between the at least one pair of retaining plates;

a releasing member, comprising:

a releasing portion slidably sleeved on the second portion of the container body, and comprising an opening in fluid communication with the inner space of the container body, an urging section located at an inner side of the releasing portion that faces the first portion of the container body, and a second plate extending from the inner side of the releasing portion toward the first portion of the container body, wherein two ends of the elastic member urge against the first portion of the container and the urging section of the releasing portion, respectively; and a protrusion portion extending from the releasing portion along the first direction;

an engaging member, having a base portion sleevably attached to the protrusion portion of the releasing member, and an engaging portion configured to receive a pressing force from a driving member of the apparatus; and a hook member having a hook body, a first hook extending downward from a first end of the hook body, and slidably received in the groove, and a fixing portion extending upward from an opposite, second end of the hook body, and fixed to the second plate; and a sealing member sleeved on the first portion, the second portion, and the releasing portion, wherein the groove comprises:

a first groove portion having a first free section, a first tail section and a first head section located between the first free section and the first tail section;

a second groove portion having a second free section, a second tail section, and a second head section connected with the first tail section and located between the second free section and the second tail section;

a third groove portion having a third head section connected with the second tail section, and a third tail section; and a fourth groove portion having a third free section, a fourth tail section connected with the first head section, and a fourth head section connected with the third tail section and located between the third free section and the fourth tail section;

wherein the first tail section is higher than the second head section, the second tail section is higher than the third head section, the third tail section is higher than the fourth head section, and the fourth tail section is higher than the first head section, such that the first hook is movable only from the first tail section to the second head section, from the second tail section to the third head section, from the third tail section to the fourth head section, and from the fourth tail section to the first head section; and wherein the island forms a notch inside the third groove portion, the notch is located between the third head section and the third tail section, and is configured to accommodate the first hook.

2. The toner supply container of claim 1, wherein at an initial state, the first hook is located at the notch of the island.

3. The toner supply container of claim 1, wherein when the toner supply container is installed to a receiving space of the apparatus, the engaging member is pressed by the pressing force to move toward the first end surface, the engaging member subsequently presses the releasing member, the urging portion of the releasing member presses the elastic member, the second plate presses the fixing portion, and the first hook is then moved from the notch to the third free section of the fourth groove portion, and then released to the fourth tail section of the fourth groove portion, such that the at least one opening of the releasing portion is exposed from the sealing member for releasing toner from the container body.

4. The toner supply container of claim 3, wherein when the engaging member is pressed again by the pressing force to move toward the first end surface, the engaging member subsequently presses the releasing member, the urging portion of the releasing member presses the elastic member, the second plate presses the fixing portion, and the first hook is then moved from the fourth tail section of the fourth groove portion to the second free section of the second groove portion, and then released to the notch of the island, such that the at least one opening of the releasing portion is closed by the sealing member.

5. The toner supply container of claim 1, wherein the island comprises a first acute portion aligning with the first head section, a second acute portion aligning with the second head section, and a third acute portion aligning with the fourth head section.

6. The toner supply container of claim 5, wherein the second acute portion and the third acute portion are located at two sides of the notch.

7. The toner supply container of claim 1, wherein a width of the groove is slightly greater than a width of the first hook.

8. The toner supply container of claim 1, wherein a depth difference between each of the first tail section and the second head section, the second tail section and the third head section, the third tail section and the fourth head section, and the fourth tail section and the first head section, is much smaller than a depth of the groove.

9. The toner supply container of claim 1, wherein a part of the groove between the first head section and the first tail section is substantially curved, and a part of the groove between the fourth head section and the fourth tail section is substantially curved.

10. The toner supply container of claim 1, wherein each of the first, the second and the third free sections is substantially straight.

11. The toner supply container of claim 1, wherein a diameter of the plate portion is greater than a diameter of the releasing portion, and the diameter of the base portion is substantially the same as a diameter of the sealing member.

12. The toner supply container of claim 1, wherein a diameter of the urging section is greater than a diameter of the releasing portion, and the diameter of the urging section is smaller than a diameter of the sealing member.

13. The toner supply container of claim 1, wherein a number of the at least one pair of retaining plates is three, and correspondingly, a number of the elastic member is three, and the three pair of retaining plates are distributed evenly along a circumference of the outer surface of the second portion.

14. A releasing mechanism usable for a toner supply container, comprising:

a groove located at the toner supply container;

a releasing portion, slidably fixable to the toner supply container, and having at least one opening for releasing toner from the toner supply container, and a fixing structure disposed over the groove for cooperating with the groove; and a hook member disposed between the groove and the fixing structure, and having a first hook slidably received in the groove, and a fixing portion fixable to the fixing structure, wherein the releasing portion is configured to receive a first force pushing the releasing portion toward the toner supply container and a second force pushing the releasing portion away from the toner supply container; and wherein by operations of the first force and the second force, the first hook is configured to slide along the groove and is stoppable at a first position of the groove close to the toner supply container and a second position of the groove away from the toner supply container, such that the releasing portion is movable relative to the toner supply container to provide or to stop providing the toner.

15. The releasing mechanism of claim 14, further comprising an engage member fixed to the releasing portion, and configured to engage with an apparatus for receiving the first force, wherein the releasing portion further has an urging section for receiving the second force.

16. The releasing mechanism of claim 14, further comprising an elastic member located between the releasing portion and the toner supply container, for providing the second force.

17. The releasing mechanism of claim 14, wherein after the releasing mechanism is attached to the toner supply container:

if the first hook is located at the first position, the opening is configured to be not in fluid communication with an inner space of the toner supply container; and if the first hook is located at the second position, the opening is configured to be in fluid communication with the inner space of the toner supply container for providing the toner.

18. The releasing mechanism of claim 14, wherein the groove comprises:

a first groove portion having a first free section, a first tail section and a first head section located between the first free section and the first tail section;

a second groove portion having a second free section, a second tail section, and a second head section connected with the first tail section and located between the second free section and the second tail section;

a third groove portion having a third head section connected with the second tail section, and a third tail section; and a fourth groove portion having a third free section, a fourth tail section connected with the first head section, and a fourth head section connected with the third tail section and located between the third free section and the fourth tail section, wherein the first tail section is higher than the second head section, the second tail section is higher than the third head section, the third tail section is higher than the fourth head section, and the fourth tail section is higher than the first head section, such that the first hook is movable only from the first tail section to the second head section, from the second tail section to the third head section, from the third tail section to the fourth head section, and from the fourth tail section to the first head section; and wherein the groove surrounds an island, the island forms the first position inside the third groove portion, the first position is located between the third head section and the third tail section, and is configured to accommodate the first hook.

19. The releasing mechanism of claim 14, wherein at an initial state, the first hook is located at the first position.

20. The releasing mechanism of claim 19, wherein when the toner supply container is installed to a receiving space of an apparatus, and the releasing portion is pressed by the first force, the fixing structure moves the hook member such that the first hook is moved from the first position to the second position, and thus the opening is exposable for releasing toner from the container supply container; and when the releasing portion is pressed again by the first force, the fixing structure moves the hook member such that the first hook is moved from the second position to the first position, and thus the opening is sealable to prevent the toner from being released.

* * * * *